US010449584B2

(12) United States Patent
Clark et al.

(10) Patent No.: US 10,449,584 B2
(45) Date of Patent: Oct. 22, 2019

(54) ADJUSTABLE DESCALER

(71) Applicant: Primetals Technologies Austria GmbH, Linz (AT)

(72) Inventors: Michael Trevor Clark, Sheffield (GB); Joseph Lee, Sheffield (GB)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 345 days.

(21) Appl. No.: 14/894,661

(22) PCT Filed: May 6, 2014

(86) PCT No.: PCT/EP2014/059186

§ 371 (c)(1),
(2) Date: Nov. 30, 2015

(87) PCT Pub. No.: WO2014/191168

PCT Pub. Date: Dec. 4, 2014

(65) Prior Publication Data

US 2016/0107214 A1 Apr. 21, 2016

(30) Foreign Application Priority Data

May 30, 2013 (GB) ..... 1309698.7

(51) Int. Cl.

| | |
|---|---|
| ***B21B 45/08*** | (2006.01) |
| ***B21B 38/00*** | (2006.01) |
| ***B21B 45/06*** | (2006.01) |

(52) U.S. Cl.

CPC ..... *B21B 45/08* (2013.01); *B21B 38/00* (2013.01); *B21B 45/06* (2013.01)

(58) Field of Classification Search

CPC ..... B21B 45/04; B21B 45/06; B21B 45/08; B21B 38/00

See application file for complete search history.

(56) References Cited

U.S. PATENT DOCUMENTS 6,385,832 B1 5/2002 Grafe et al.

FOREIGN PATENT DOCUMENTS

| | | | |
|---|---|---|---|
| CN | 202028622 | U | 11/2011 |
| CN | 102716922 | A | 10/2012 |
| CN | 102755997 | A | 10/2012 |
| DE | 10332693 | A1 | 2/2005 |
| DE | 102009058115 | A1 | 6/2011 |
| EP | 1167577 | A2 | 1/2002 |
| EP | 1167577 | B1 | 4/2008 |
| JP | S5540978 | A | 3/1980 |

(Continued)

OTHER PUBLICATIONS

Notice of Reasons for Rejection dated Feb. 13, 2017 in corresponding Japanese Patent Application No. 2016-515692 (with English language translation)(total 7 pages).

(Continued)

*Primary Examiner* — Teresa M Ekiert
(74) *Attorney, Agent, or Firm* — Ostrolenk Faber LLP

(57) ABSTRACT

An adjustable descaling device for a rolling mill (20) for rolling a metal product (10) on a rolling line comprises one or more descalers (13*a*, 13*b*, 14*a*, 14*b*), at least one scale detection sensor (17, 18); and a processor (19). The sensor detects a scale pattern on a surface of the metal product (10) after descaling of the product. The processor adjusts the descaling impact pattern according to the detected scale pattern provided by the sensor.

17 Claims, 5 Drawing Sheets

(56) References Cited

FOREIGN PATENT DOCUMENTS

| | | | |
|---|---|---|---|
| JP | S601169580 | A | 9/1985 |
| JP | S6130685 | B2 | 7/1986 |
| JP | H07256331 | A | 10/1995 |
| JP | H10-128423 | A | 5/1998 |
| JP | H10282020 | A | 10/1998 |
| JP | H1110204 | A | 1/1999 |
| JP | 2002-082061 | A | 3/2002 |
| JP | 2010240660 | A | 10/2010 |
| KR | 100349170 | B1 | 8/2002 |
| KR | 20030030183 | A | 4/2003 |
| KR | 20040024022 | A | 3/2004 |
| KR | 20040056057 | A | 6/2004 |
| KR | 100779683 | B1 | 11/2007 |
| KR | 100882705 | B1 | 2/2009 |
| KR | 100953625 | B1 | 4/2010 |
| KR | 101014922 | B1 | 2/2011 |
| WO | WO 2010145860 | A1 | 12/2010 |

OTHER PUBLICATIONS

Berthold Hild, "Wasserhydraulik in Der Anwendung-Entzunderungssysteme in Walzwerks-Anlagen" (Water Hydraulics in Application—Descaling Systems in Rolling Plants) O + P Olhydraulik und Pneumatik Vereinigte Fachverlage, Mainz, DE, vol. 43, No. 6, Jun. 1, 1999; ISSN: 0341-2660; XP00834232 (the whole document).

International Search Report dated Jul. 17, 2014 issued in corresponding International patent application No. PCT/EP2014/059186.

International Preliminary Report on Patentability dated Aug. 25, 2015 issued in corresponding International patent application No. PCT/EP2014/059186.

First Office Action with Search Report dated Oct. 10, 2016 in corresponding Chinese Patent Application No. 201480031171.9 (with English language translation)(total 13 pages).

Jürgen W. Frick, Lechler GmbH,"Audits of Existing Hydro Mechanical Descaling Systems in Hot Rolling Mills as a Method to Enhance Product Quality," Apr. 10, 2007 (12 pages).

PRIOR ART

PRIOR ART

ADJUSTABLE DESCALER

CROSS-REFERENCE TO RELATED APPLICATIONS

The present application is a 35 U.S.C. §§ 371 national phase conversion of PCT/EP2014/059186, filed May 6, 2014, which claims priority of British Patent Application No. 1309698.7, filed May 30, 2013, the contents of which are incorporated by reference herein. The PCT International Application was published in the English language.

TECHNICAL FIELD

This invention relates to an adjustable descaler and a method of descaling materials, in particular where the thickness of the material varies along its length.

TECHNICAL BACKGROUND

In the hot rolling of steel and other metals, it is very common to use high pressure water jets to remove the scale which forms on the surface of the material, in particular in plate and Steckel Mills, or hot strip mills, but descaling may be required in other types of mill.

Most high pressure water descaling systems use flat fan shaped jets as illustrated in FIGS. 1A and 1B. FIG. 1A shows a side view. A header 1 supplies water through a nozzle 2 as a spray 6 to a surface 3 of a plate to be descaled, which is moving in the direction of the arrow 4. A nozzle tip 5 is positioned at a standoff distance h2 above the surface 3 and has an angle of inclination of the nozzle from the vertical β. The angle of inclination is intended to prevent the high pressure water and scale bouncing back from the surface of the slab from interfering with the direct jet from the nozzle tip. FIG. 1B illustrates this seen from end on. The header 1 has multiple nozzles 2, separated by a distance E. Across the width of the plate or material, the spray 6 extends over a spray angle α. Adjacent sprays 6 across the width overlap by an amount D. Seen from above, each spray is offset by an offset angle γ relative to a line across the width of the plate, perpendicular to the direction of movement. The offset angle is intended to prevent neighboring jets from interfering with each other.

One problem with using these flat fan shaped jets is that the overlap area 7 and distance D between adjacent jets 6*a*, 6*b* produced by each nozzle is very critical for the performance of the descaling. This is illustrated in FIGS. 2 and 3. If D is too big, i.e. there is too much overlap between the jets, as illustrated in FIG. 2, then water flow 8 on the surface 3 of the material which is created by the leading jet 6*a* in the overlap region 7 gets in the way of the jet 6*b* from the 'following' jet in the overlap region and reduces the impact of this following jet on the material in the overlap region 7 which can result in stripes with poor descaling on the surface of the material. This phenomenon is described in FIG. 6 and the associated text of the article "Audits of Existing Hydromechanical Descaling Systems in Hot Rolling Mills as a Method to Enhance Product Quality: Juergen W. Frick, Lechler GmbH". If the overlap D is too small, or even negative, i.e. there is a gap between adjacent jets 6*a*, 6*b* as shown in FIG. 3, then the material is not descaled properly and this also produces stripes with poor descaling. This phenomenon is also described in the Audits article mentioned above in FIG. 6 and the associated text.

SUMMARY OF THE INVENTION

In accordance with a first aspect of the present invention, an adjustable descaling device for a hot rolling mill for hot rolling a metal product on a rolling line comprises one or more descalers, the descalers comprise high pressure water jets; at least one scale detection sensor; and a processor; wherein the sensor is adapted to detect a scale pattern across the width of the product on a surface of the metal product after descaling of the product; and wherein the processor is configured to adjust a descaling impact pattern, according to the detected scale pattern provided by the sensor.

The present invention avoids the problems encountered in conventional descalers by adjusting the descaler impact pattern for a subsequent descaling based on a detected scale pattern from a product after the product has been descaled, so optimizing the interaction of the spray of adjacent jets.

Where more than one descaler is provided, in use, they may all be upstream of the rolling mill, or alternatively one descaler is positioned ahead of the hot rolling mill and the other is positioned after the hot rolling mill along the rolling line.

Preferably, for each descaler a corresponding sensor is provided.

Preferably, the scale detection sensor comprises one of a scanning pyrometer; a CCD camera system; an X-ray device; a scale thickness sensor; or a spectral analysis system.

Preferably, a single sensor is adapted to detect scale on opposing surfaces of the metal product.

Preferably, the or each descaler comprises a header and a series of nozzles set at a predetermined pitch.

Preferably, the or each descaler comprises a set of two descaler modules, mounted such that one descaler module is operable to descale one surface of the metal product and the other descaler module is operable to descale an opposite surface of the metal product.

Preferably, at least one of the descaler modules comprises a height adjustable descaler module. Adjusting the height of the descaler module alters the descaling impact pattern.

Preferably, at least one of the descaler modules comprises a descaling pressure control mechanism.

Adjusting the descaling pressure alters the descaling impact pattern. The mechanism by which the descaling impact pattern is adjusted is not limited to adjusting the height of the descaler module or controlling descaling pressure of the jet for the material being descaled. Other parameters may be adjusted.

Preferably, the nozzles of one descaler in the device are set at a different nozzle pitch to the nozzles of another descaler in the device. This helps the correlation to identify which header needs to be adjusted.

Preferably, the nozzles of one descaler in the device have a different linear offset along the axis of the header to the nozzles of another descaler in the device. This also helps the correlation to identify which header needs to be adjusted.

In accordance with a second aspect of the present invention, a method of operating an adjustable descaling device for a hot rolling mill for hot rolling metal comprises: descaling a metal product using high pressure water jets; using one or more scale detecting sensors to determine a representation of a scale pattern across the width of the metal product on a surface of a metal product being rolled, after descaling; in a processor, comparing the determined scale pattern with a stored correlation pattern; determining if the result of the comparison is outside an acceptable range of tolerance and, if so, adjusting one or more descalers of the descaling device according to the result of the comparison.

Preferably, the adjustment of the one or more descalers comprises at least one of adjusting the height of one or more of the descalers relative to a roller table on which the product is supported, or relative to the top or bottom surface of the material; adjusting the pressure in a header of the one or more descalers.

Preferably, the method further comprises using a 1-D Rosenbrock type algorithm to adjust the height of the one or more descalers in response to the correlation.

Preferably, the stored correlation pattern comprises a representation of nozzle pitch of a header of the descaler.

Preferably, the method further comprises compensating for width spread during rolling, or for the effects of initial broadside rolling.

Preferably, the method further comprises monitoring which of the one or more descalers have been in operation in order to generate a scale pattern and adapting the results of the correlation comparison accordingly.

Preferably, the method further comprises filtering and averaging signals from the one or more sensors representing the scale pattern over a period of time before carrying out the comparison.

Preferably, the method further comprises calibrating the correlation system by introducing a height offset in a test measurement stage.

BRIEF DESCRIPTION OF THE DRAWINGS

An example of an adjustable descaler and a method of its operation are now described with reference to the accompanying drawings in which.

DESCRIPTION OF EMBODIMENTS

As described above with respect to FIGS. 1 to 3, there can be problems if the overlap of adjacent jets is too large or too small. Jet manufacturers specify the optimum overlap for each type of j et based on a characteristic 'edge drop' for that particular jet i.e. how quickly the impact pressure drops away towards the edge of the jet. However, in practice, it is found that different batches of nozzles can have slightly different spray angles $\alpha$ and edge drop characteristics and that the spray angle and edge drop also vary with the descaling pressure and with the wear of the nozzles. If the mill decides to change nozzle supplier (e.g. for cost reasons, or for a local supplier), then the differences in spray angles and edge drop characteristics can be even more significant -even if the 'catalogue' figures for the nozzles are the same.

Figure 1A:
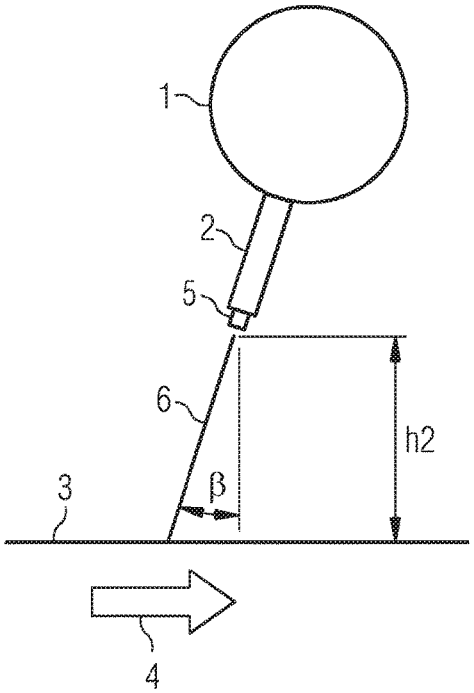
FIGS. 1A and 1B illustrate a conventional descaler spray arrangement.
Figure 1B:
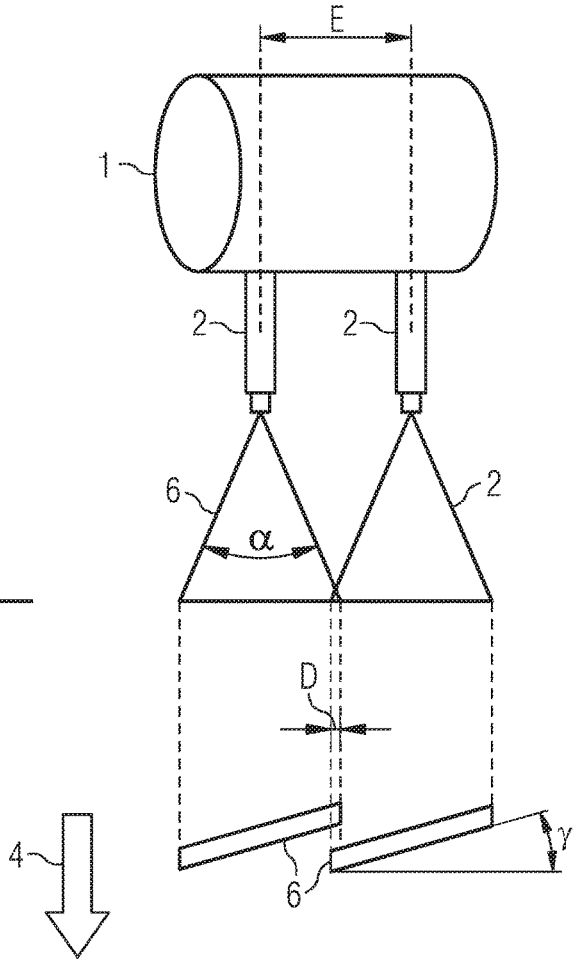
PRIOR ART FIG 1B
Figure 2:
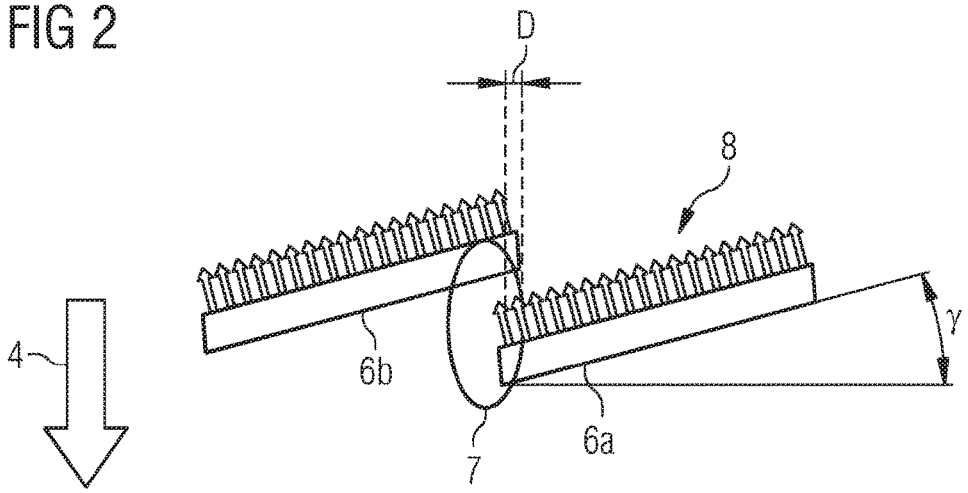
FIG. 2 illustrates the spray pattern for the descaler of FIGS. 1A and 1B with too much overlap.

In conventional designs, the nozzle spacing, E in FIG. 1B, is fixed by the design of the header, so the only thing which can be adjusted in order to optimize the overlap is the standoff distance h2 in FIG. 1A. If the actual standoff distance is greater than the design figure then the impact pressure of the jets will be reduced and descaling will not be as effective. If the actual standoff distance is significantly less than the design figure then the jets will no longer overlap and the slab will have stripes of scale left along it. Most plate mills use a variety of slab thicknesses and therefore the top headers in the primary descalers can usually be adjusted for height using screwjacks, hydraulic cylinders or other actuators. A control system sets the correct header height for a particular slab before the slab enters the descaler, so that the standoff h2 is approximately the same whatever is the slab thickness.

Figure 3:
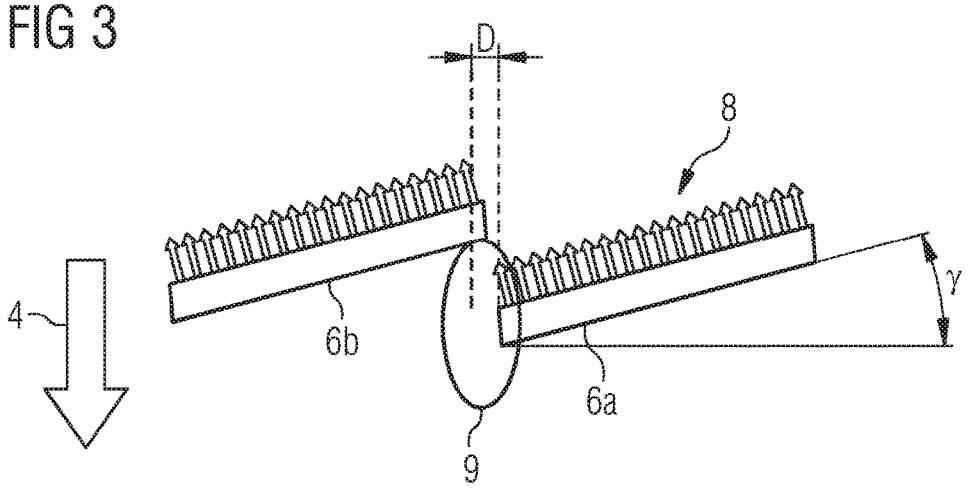
PRIOR ART FIG 3
FIG. 3 illustrates the spray pattern for the descaler of FIG. 1A and 1B with too little overlap.

Descalers are often described as either primary descalers or secondary descalers. The primary descaler is the descaler which is used to descale the slab when it comes out of the furnace and before rolling starts. The secondary descaler is usually located on the rolling mill itself in the case of plate mills and roughing mills, or just in front of the mill in the case of finishing mills. It is very common for primary descalers to have adjustable height top headers, for example as illustrated in FIGS. 1 and 3 of WO2010145860 or in U.S. Pat. No. 6,385,832, because they have to descale slabs with different thicknesses. The height adjustment of these top headers is done in 'open-loop', i.e. the control system for the mill tells the descaler control system what the slab thickness is, and the descaler control system adjusts the height of the top header to the slab thickness plus a nominal standoff distance h2.

If the mill has any descaling problems—which are usually detected by visual observation—then it might do a descaling impact test, such as that illustrated in FIG. 7 of the "Audits . . . " paper referenced above. Common methods for this type of test include using lead sheet or aluminium sheet attached to a slab or using a painted slab. The test slab is positioned under the descaler and the descaling is switched on for a short time. Afterwards the impact pattern can be examined visually. If the test indicates that there is excessive overlap, or insufficient overlap, then the nominal standoff distance h2 for the top header can be adjusted by simply entering the new parameter into the control system.

Whilst the top headers in primary descalers are easily adjusted for height, the bottom descaling headers are usually fixed. Generally, the bottom headers do not need to be moved because the bottom surface of the slab is always in the same place, on top of the rollers. If any adjustment is possible, it is only by changing the shims or packers which support the bottom headers and pipework.

The top headers in most secondary descaling systems are attached to the entry or exit guide assemblies on the mill, in such a way that as the top work roll of the mill moves up and down to accommodate different slab and plate thicknesses the header moves up and down with the roll. An example of this is shown in FIG. 1 of DE102009058115. However, the standoff height of the header from the top surface of the material is not absolutely constant with this type of design. There are two main reasons for this. First, the top roll changes diameter through wear and grinding, and because the guide which supports the header is located on the roll chock assembly and not on the roll itself, this produces small changes in the standoff distance. CN202028622 describes one method of trying to overcome this effect. The second reason is that the top surface of the material is at a different height relative to the roll depending on the rolling draft. KR101014922 describes a header design which is adjustable in height relative to the guide assembly so that the distance to the top of the material can be kept the same, whatever the draft. Although, the bottom headers in most secondary descaling systems are set at a fixed height, KR101014922 mentions that adjustment could also be applied to the bottom headers.

Other examples of systems in which the problem of maintaining the correct overlap between the jets has been recognised and solutions for compensating for changes in the water pressure, the rolling draft and the thickness have been proposed include KR2003030183, which describes a system in which the height of the descaling header is adjusted according to the actual descaling pressure in order to keep the spraying width constant, KR100779683 which describes a system in which the descaling height and the water pressure are adjusted to give optimum descaling according to the thickness and temperature of the bar, KR20040056057 which describes a system in which the height of the descaling header can be adjusted for turned up ends on the plate and KR20040024022 which describes another system in which the height of the descaling header can be adjusted.

Other patents or patent applications describe using measurements of the scale pattern on the surface of the plate to control operation of the descaler. This feature is present for example in JP07256331, which describes a descaling system in which there is a scale thickness sensor which measures the distribution of scale across the surface of the plate. The signal from the scale thickness sensor is used to control additional descaling nozzles which can be positioned near the edge of the plate. JP10282020 describes an X-ray scale thickness and composition measuring device, which uses this information to determine the optimum removing conditions for the scale. JP11010204 describes using a scale defects detector to control the rolling temperature and the draft in the stands of a finishing mill in order to influence the amount and type of scale produced. JP55040978 describes a system for detecting scale defects and displaying these to the operator. KR100349170 describes a system for detecting scale using CCD cameras.

The present invention addresses the problem of how to improve the descaling. One embodiment of the invention adjusts the standoff distance to improve the descaling. In the present invention, the standoff distance h2 may be adjusted for some, or for all of the descaling headers in the mill, ideally to achieve optimum descaling, but at least to reduce the incidence of stripes on the material. In order to achieve the desired improvement, the system must be able to change the height of the headers relative to the surface of the material and to detect when an acceptable descaling result has been achieved, or that the descaling has not reached the required quality and that adjustment is required.

Figure 4:
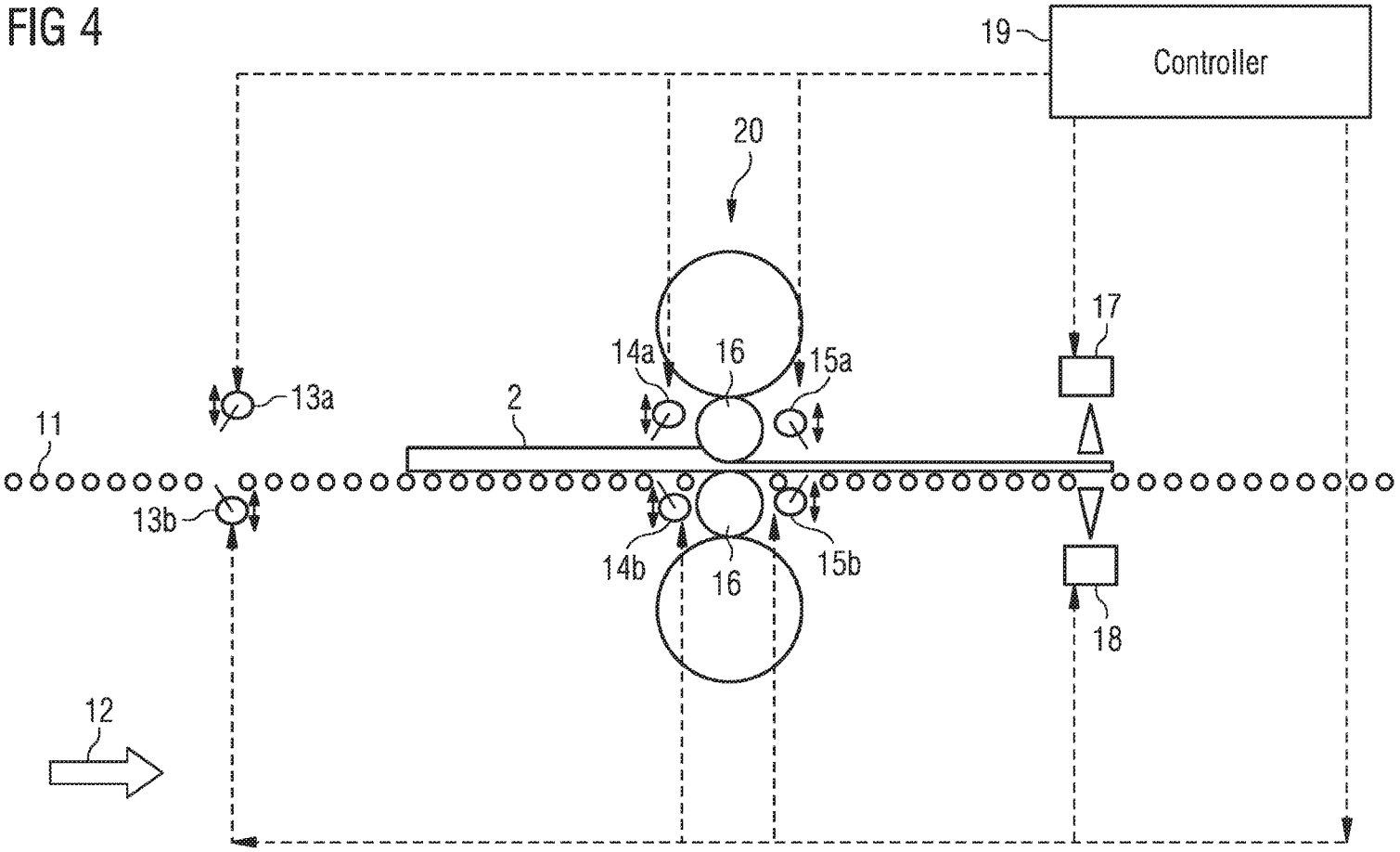
FIG. 4 illustrates an example of an adjustable descaler according to the present invention.

An example of an adjustable descaler according to the present invention is illustrated in FIG. 4. A slab 10 for descaling moves along a roller table 11 in the direction of arrow 12. Descalers may be provided above and below the roller table at various positions along the roller table. In this example, two sets of descalers 13*a*, 13*b*, 14*a*, 14*b* are at positions upstream of the work rolls 16 in the rolling mill 20. After this initial descaling, the material passes through the mill and is rolled and another set of descalers 15*a*, 15*b* may be provided at a position downstream of the work rolls, so that descaling is also carried out after the material has been rolled. For example, the downstream descalers 15*a*, 15*b* may be used to descale on a reverse pass i.e. when the material is travelling in the other direction in a reversing mill. Secondary descalers are usually built into the mill entry guides, so they are fairly close, although in strip mills, the secondary descaler may be separate from the stand. The number of descalers may be varied, for example a single pair of descalers, either upstream or downstream of the work rolls may be used, or more than one set, in some cases with at least one set provided upstream of the workrolls and at least one set downstream of the work rolls.

Downstream of the descalers, top and bottom surface scale sensors 17, 18 are positioned above and below the roller table respectively, in order to detect the descaling pattern on the surface of the plate 10. These sensors are coupled to a controller 19 which uses information derived from the sensed descaling pattern to adjust a parameter of the descaling device to alter the resultant descaling pattern. In one example, the height of the descaling headers is adjusted. Alternatively, the pressure of the descaling headers may be controlled. The controller has connections to each of the descalers 13*a*, 13*b*, 14*a*, 14*b*, 15*a*, 15*b* and can cause actuators, on whichever of the descalers needs to be moved, to operate to reposition the descaler relative to the roller table and hence the plate. The height adjustment may be limited to only one of the descalers in a set, usually the upper descaler, 13*a*, 14*a*, 15*a* but ideally both top and bottom descalers in each set are height adjustable.

For existing installations height adjustment of both of a set of descalers may not be practical, in which case the system of the present invention may be used with the headers which are height adjustable. In addition, a pressure control mechanism may be provided and the device is set to have a higher or lower pressure to change the jet from the nozzle header and hence the descaling impact pattern. Generally, this is done for the headers which are not height adjustable, rather than independently of the height adjustment, using the information from the sensor to adjust the descaling pressure, for example using variable speed pumps or a flow control valve, in order to adjust the descaling spray width. This is because reducing the descaling pressure also reduces the effectiveness of the descaling and conversely it may not be possible to increase the descaling pressure. However, using pressure adjustment alone is not excluded.

One of a number of different sensors may be used to detect the surface scale. The simplest and most versatile sensor to use is a scanning pyrometer. Many mills already have scanning pyrometer equipment installed and it is well known that scale stripes can be detected by this type of sensor. An alternative sensor is a CCD camera system looking at the surface for visible defects. These systems are widely used for detecting surface defects during rolling and are readily available. Other alternatives include X-ray or scale thickness sensors and spectral analysis type systems (e.g. FTIR systems). As long as the sensor can detect stripes with poor descaling on the surface of the material, it may be used. Some sensors are able to measure scale on both the top surface and the bottom surface. Where this is not possible, separate sensors are used for each surface, as shown in the example of FIG. 4. The mill is not limited to using only a single sensor 17, 18 located after the rolling mill as shown in FIG. 4, but in some cases multiple sensors, for example after the primary descaler and either side of the mill (not shown) may be used.

Figure 5:
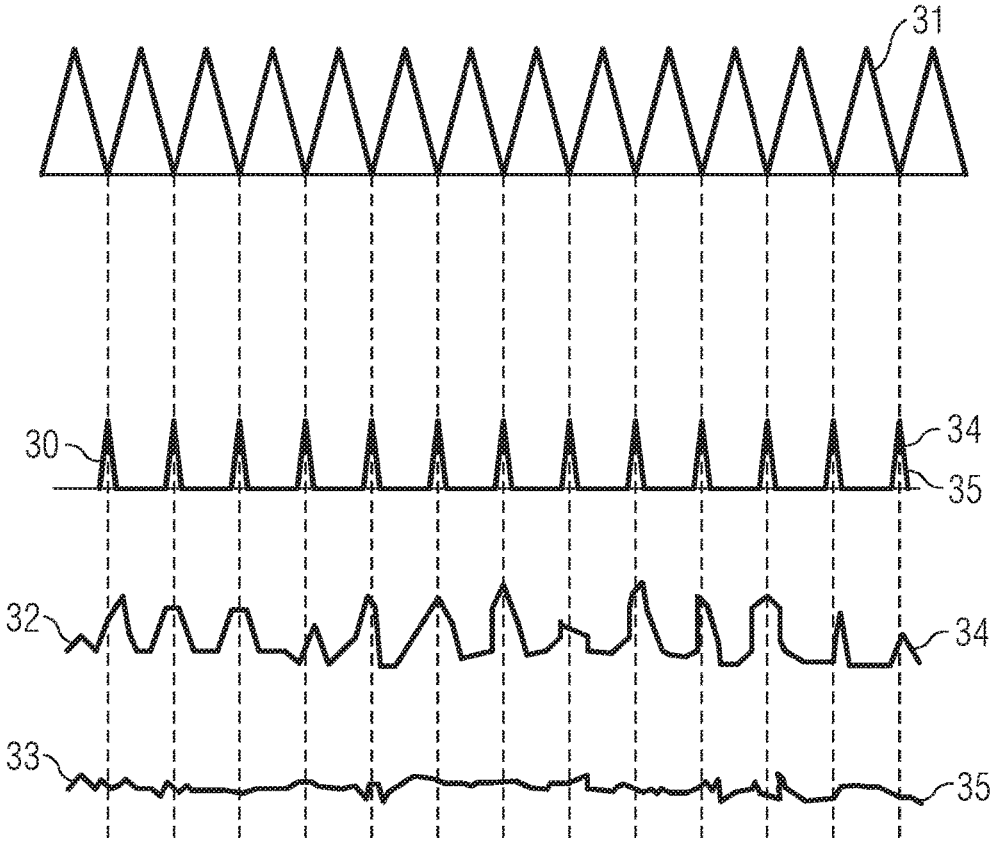
FIG. 5 illustrates graphically correlation patterns and sensors signals.

The signal from the sensor 17, 18 is analyzed by the controller 19 to determine whether there is any correlation between the measured scale pattern across the width of the material and the known pitch E of the descaling nozzles. If there is a correlation between the measured scale pattern across the width of the material and the pitch of the nozzles then this suggests that the standoff distance of the nozzles may not be optimum. Examples of this effect are illustrated in FIG. 5. A correlation pattern 30 for the known nozzle positions 31 is compared with a sensor signal 32. This can be seen to be strongly correlated 34, indicating a non-optimum scale pattern and nozzle standoff distance h2. By contrast, another sensor signal 33 shows a very weak or zero correlation 35 with the pitch of the nozzles, indicating that the scale pattern and nozzle standoff distance h2 are close to optimum.

In the case where there is only one sensor located after the mill there is the additional complication that variations in the descaling effectiveness might be due to either the primary descaler or the entry side secondary descaler or the exit side secondary descaler. In the case of the secondary descalers, ideally the exit side descaler is offset by half a nozzle pitch (the spacing between the nozzles) relative to the entry side descaler so that the system can easily distinguish one from the other. In the case of the primary descaler the pitch is chosen to be different from the secondary descaling so that the pattern due to the primary descaler can be distinguished compared to the pattern from the secondary descaling. The system also takes into account which descaling headers have actually been used during the rolling of the piece being measured; for example if only the entry side descaling has been used then the system does not look for any correlation with the exit side descaling pattern.

Another complication is that in plate mills the slab is often rolled broadside on for one or more passes in order to achieve the required plate width. This results in two effects. Firstly, any descaling pattern across the width that has been created before the turning of the slab will end up being spread out to the new width. Consequently when the descaling pattern is measured by the sensor, the pattern will have a spacing between stripes of the pattern, the pattern pitch, which is related to the actual spacing of the nozzles, the nozzle pitch, times the ratio of the final width of the slab to the width when the slab was first descaled in its broadside orientation. Secondly, any descaling pattern which is produced during the broadside rolling phase will become a longitudinal pattern along the length of the rolled piece and the longitudinal pitch will be the nozzle pitch times the ratio of the final length to the broadside width. A related point is that the width of the slab generally increases slightly during rolling which will alter the pitch observed by the sensor. If the mill is equipped with an edger, then it is possible for the final width to be narrower than the initial width. It is relatively simple for the system to account for these changes in width relative to the width at which the piece was descaled by adjusting the pitch for the correlation analysis.

Usually the piece being rolled is descaled several times during the rolling sequence. If the sensor is sufficiently close to the mill then it is possible to analyze the scale pattern after each pass for at least part of the length of material rolled in that pass. If the sensor is some distance from the mill, then it might only be possible to analyze the scale pattern after all the rolling and descaling has been completed. In this case, any width changes during the rolling will tend to blur the pattern, but in most cases there will still be some correlation with the nozzle pitch.

Having analyzed the scale pattern and found a correlation with the pitch of a particular descaling header, the system then needs to determine whether to move the descaling headers up or down. The problem is that both excessive overlap and insufficient overlap both lead to poor descaling and stripes on the surface. As set out in the 'Audits . . . ' article referred to above and shown, conventional methods of determining whether the descaler has excessive overlap, or insufficient overlap, can only be carried out when the mill is not rolling.

Although, with certain types of sensor, such as a scanning pyrometer, it is possible, for example to distinguish between a plate with insufficient overlap which has hot stripes and a plate with excessive overlap which does not have hot stripes, this method is complicated by the different emissivity of a surface which has not been properly descaled compared to the surface that has been properly descaled. Most pyrometers would detect the change in emissivity as a change in temperature and this confuses the analysis of the signal.

Therefore a simple iterative scheme based on a 1 dimensional Rosenbrock optimization method is proposed. If the system detects a correlation between the pitch of the scale measurement and the pitch of a descaling header, then the system moves the height of that header a small distance in one direction or the other. This initial direction may be selected at random, but it is preferred that the choice of likely direction is based on historical data. For example, the spray angle usually increases with nozzle wear and so a movement towards the strip would compensate for this. In the case of a new installation which has not been calibrated at all, the system may start with header height deliberately offset in one direction away from the theoretical optimum and with the direction of the first movement towards the theoretical position. Alternatively, the system may start with the header at the theoretical optimum position and with a preset or random initial movement direction. Having moved the header, the system then waits for another plate to be rolled, ideally a similar plate with similar descaling and compares the correlation. If the correlation is stronger, then the movement was clearly in the wrong direction, whereas if the correlation is weaker, then the movement was in the right direction. If the movement seems to be in the right direction, then the system makes another movement in that direction. If the movement seems to be in the wrong direction then the system moves the height in the opposite direction.

If data is only available after each plate has been rolled, then this simple iterative scheme moves the header to the optimum height after a few plates have been rolled. If data is available during the rolling of a plate then the system can optimize the height within a few passes. To prevent the system from hunting around the optimum height, a threshold correlation can be set such that if the correlation is less than this threshold, the system keeps the header at the same height. If desired, the algorithm makes larger or smaller movements, depending on the level of the correlation, or the algorithm may use a variable step size type algorithm where the step size gradually increases for every movement in the same direction, but reduces quickly when the direction of movement changes. Filtering and averaging of the signals over part or the entire surface of one or more plates may be used to ensure that the system does not overact to errors in the measurements.

Optionally, the pattern against which the measurements are correlated is calibrated by deliberately introducing a significant error in the header height and making a measurement on a test plate.

Figure 6:
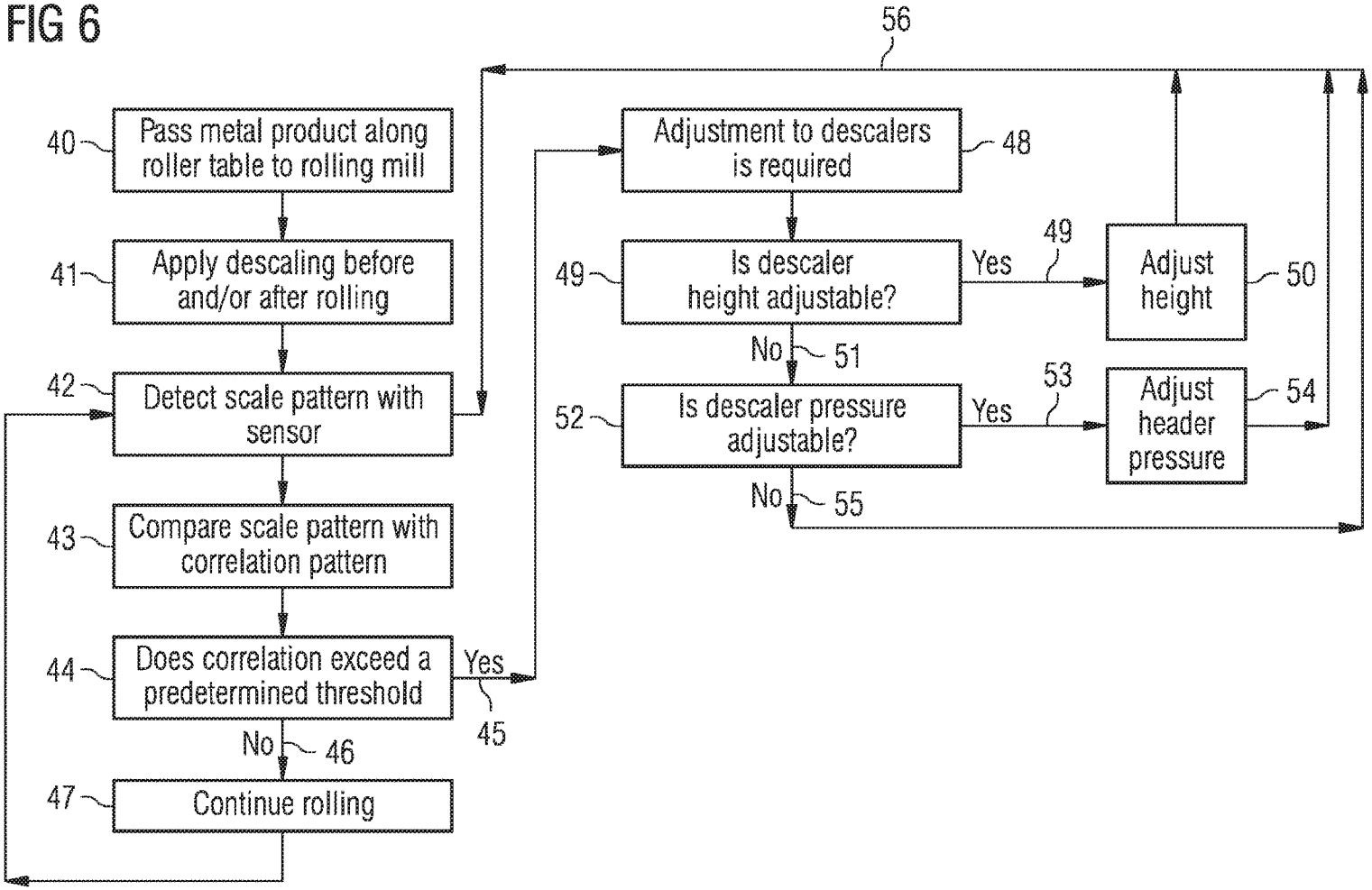
FIG. 6 is a flow diagram of a method of operating the descaler of FIG. 4.

FIG. 6 is a flow diagram illustrating a simplified example of operating an adjustable descaler according to the present invention. The metal product being rolled is passed 40 along the roller table to the rolling mill. Descaling is applied 41, either before or after rolling, or both before and after rolling. The sensor 17, 18 detects 42 the scale pattern and sends a signal to the controller 19. The signal representing the detected scale pattern is compared 43 with a correlation pattern, typically stored data relating to the pitch of the nozzles of the descaler, to see whether the correlation between the detected and stored patterns exceed 44 a predetermined threshold. If the correlation exceeds 45 the threshold, then adjustment 48 of the descalers is required. If the correlation does not exceed 46 the threshold, then rolling continues 47 and if not yet complete, the scale pattern is again detected 42 with the sensor and the process repeated.

If the correlation does exceed 45 the threshold and it has been determined that adjustment 48 is required, further steps (not shown) may be required, for example to determine whether there are multiple descalers, some or all of which are in use and whether each of those descalers has its own associated sensor (in which case the pattern can be attributed to each specific descaler) or whether there is only a single sensor for all of the descalers, or fewer sensors than descalers. Additionally, if compensation for initial broadside rolling is required, this is applied at this stage. The controller then determines whether the descaler to be adjusted is able to have its height adjusted 49 and if not 51, then whether it is able to have its header pressure adjusted 52. If adjustment is possible, the appropriate height and/or header pressure adjustment 50, 54 is then applied and the detection of scale pattern by the sensor continues, or rolling finishes. If neither height nor pressure 55 can be adjusted further for a particular descaler, no adjustment is made and detection continues, or rolling finishes. In this example, adjustment of height or pressure are proposed in order to adjust the descaling impact pattern, but any suitable parameter may be adjusted for this purpose.

Although, as discussed above, detecting scale is well known, as is adjusting the height of the spray nozzles, none of the prior art makes any suggestion of using measurements of the scale pattern on the surface of the plate as the basis for controlling adjustment of the height or other characteristics of the descaling headers in order to improve or optimize the descaling operation.

Different nozzle pitches or different linear offsets along the axis of the header may be set in different headers of the descalers, to assist in identifying which header needs adjusting.

In summary, a sensor may be used to detect scale stripes on the surface of the plate which correlate with known positions of the overlap between adjacent descaling nozzles and this correlation is used to adjust the descaling system to minimize the stripes. The adjustment may be in the form of adjusting the height of the headers in response to the sensor correlation, or adjusting the descaling pressure (e.g. for those headers which are not height adjustable) in response to the sensor correlation. The measured pattern may be compensated for width spread and broadside rolling etc. Information on which headers have been in operation when carrying out the correlation analysis may be used. The sensor signals may be filtered and averaged. The sensor signal may be used to identify whether the header is too high or too low. A 1-D Rosenbrock type algorithm may be used to adjust the height of the headers in response to the correlation. A height offset may be deliberately introduced for a test to calibrate the correlation system.

The invention claimed is:

1. An adjustable descaling device for a hot rolling mill for hot rolling a metal product on a rolling line, the descaling device comprising a plurality of descalers each comprising multiple high pressure water jet descaling nozzles configured for descaling the metal product by spraying water on a surface, and across a width, of the metal product on the rolling line;

at least one scale detection sensor configured and operable to detect a scale pattern on the surface, and across the width, of the metal product after the descaling of the metal product by a first descaler of the descalers;

a processor configured and operable to adjust a descaling impact pattern of water sprayed on the metal product by the first descaler based on a detected scale pattern provided by the at least one scale detection sensor and a determined relationship between the detected scale pattern and a pattern of known pitch between the descaling nozzles of the first descaler across the width of the metal product, wherein the processor determines whether to adjust a standoff distance of the descaling nozzles of the first descaler from the metal product based on a predetermined threshold value indicating a correspondence between the detected scale pattern and the pattern of known pitch between the descaling nozzles of the first descaler, and wherein the processor determines that the standoff distance of the descaling nozzles of the first descaler does not need to be adjusted when the predetermined threshold is not determined by the processor.

2. A device according to claim 1, wherein each descaler is associated with a respective sensor positioned and operable to sense the descaling performed by its associated descaler.

3. A device according to claim 1, wherein the at least one scale detection sensor comprises one of a scanning pyrometer, a CCD camera system, an X-ray device, a scale thickness sensor, or a spectral analysis system.

4. A device according to claim 1, further comprising another sensor configured to detect descaling on a surface opposite to the surface of the metal product.

5. A device according to claim 1, wherein each descaler comprises a header and a series of water jet descaling nozzles, from among the water jet, descaling nozzles, settable at a predetermined pitch on the header selected and configured to apply the spray onto the surface of the metal product for separating the sprays from the nozzles along the metal product.

6. device according to claim 5, wherein the nozzles of one descaler have a different linear offset along the axis of their header to the nozzles of another descaler.

7. A device according to claim 1, wherein each descaler comprises a set of two descaler modules, configured and mounted within the device such that one of the descaler modules is operable to descale one surface of the metal product and the other descaler module is operable to descale an opposite surface of the metal product.

8. A device according to claim 7, wherein at least one of the descaler modules comprises a height adjustable descaler module adjustable in height with reference to the surface of the metal product for adjusting the standoff distance.

9. A device according to claim 7, wherein at least one of the descaler modules comprises a descaling pressure control mechanism configured for controlling the pressure of the water jets of water jet descaling nozzles of the at least one of the descaler modules.

10. A device according to claim 1, wherein the nozzles of one descaler are set at a different nozzle pitch to the nozzles of another descaler, the nozzle pitches are selected and configured to set the sprays onto the surface of the metal product at a selected pitch for separating the sprays from the nozzles along the metal product.

11. A method of making a metal product in a hot rolling mill that includes an adjustable descaling device, wherein the adjustable descaling device comprises descalers each having descaling nozzles;

the method comprising:

descaling the metal product using by spraying high pressure water jets from the descaling nozzles of a first descaler of the descalers on a surface, and across a width, of the metal product;

after the descaling, operating one or more scale detecting sensors configured to determine a determined scale pattern representing a scale pattern on the surface, and across the width, of the metal product resulting from the descaling by the first descaler;

in a processor, comparing the determined scale pattern across the width of the metal product with a stored pattern of known pitch between the descaling nozzles of the first descaler;

determining the result of the comparing is outside an acceptable range of tolerance; and in response to determining that the result of the comparing is outside the acceptable range of tolerance, adjusting, with the processor, a standoff distance of the descaling nozzles of the first descaler based on a predetermined threshold value indicating a correspondence between the determined scale pattern and the pattern of known pitch between the descaling nozzles of the first descaler, wherein, prior to the adjusting, the processor determines whether the standoff distance of the descaling nozzles of the first descaler needs to be adjusted, and the standoff distance is adjusted when the predetermined threshold is determined by the processor.

12. A method according to claim 11, wherein the hot rolling mill is configured to move the metal product in a direction on a rolling line and one of the descalers is positioned ahead of the hot rolling mill in the direction and another one of the descalers is positioned after the hot rolling mill in the direction along the rolling line.

13. A method according to claim 11, wherein the standoff distance is a height standoff relative to a roller table on which the product is supported, or relative to a top or a bottom surface of the metal product, and wherein the method further comprises adjusting the pressure in a header of the descalers.

14. A method according to claim 13, further comprising using a 1-D Rosenbrock algorithm in the adjusting of the height of the descalers.

15. A method according to claim 11, wherein the metal product is subjected to rolling in the hot rolling mill, and further comprising compensating for width spread during rolling or for effects of initial broadside rolling.

16. A method according to claim 11, wherein the one or more sensors generate signals, and further comprising filtering and averaging signals from the one or more sensors over a period of time to determine the scale pattern before carrying out the comparing.

17. A method according to claim 11, further comprising calibrating the device by introducing a height offset in a test measurement stage before operating the operating one or more scale detecting sensors.

* * * * *